United States Patent [19]

Johnson

[11] Patent Number: 4,786,003

[45] Date of Patent: Nov. 22, 1988

[54] MATERIALS PROCESSING UNIT

[76] Inventor: Raymond N. Johnson, Unit 4/77 Gould Street, Bondi, New South Wales, Australia

[21] Appl. No.: 921,585

[22] Filed: Oct. 21, 1986

[30] Foreign Application Priority Data

Oct. 22, 1985 [AU] Australia ..... PH3022

[51] Int. Cl.[4] ..... B02C 21/02

[52] U.S. Cl. ..... 241/101.7; 241/154

[58] Field of Search ..... 241/152 A, 154, 29, 241/DIG. 37, 189 R, 101.7, 74, 73, 60, 188 R

[56] References Cited

U.S. PATENT DOCUMENTS

| | | | |
|---|---|---|---|
| 2,695,755 | 11/1954 | Denovan et al. | 241/154 X |
| 4,072,273 | 2/1978 | Reiniger | 241/29 X |
| 4,287,708 | 9/1981 | Neely | 241/101.7 X |
| 4,330,091 | 5/1982 | Rozeboom et al. | 241/101.7 X |
| 4,577,805 | 3/1986 | Seymour | 241/101.7 X |

FOREIGN PATENT DOCUMENTS 534596 2/1984 Australia .

*Primary Examiner*—Mark Rosenbaum

*Attorney, Agent, or Firm*—Pearne, Gordon, McCoy & Granger

[57] ABSTRACT

A materials processing unit incorporating three stage processing. The material to be processed is passed through a breaker unit (19) which breaks the material down to a consistent size for processing by a pulverizer unit (20) which further breaks down the material before it is transferred to a container (13) for compacting by ram (27) and blade (28). The material may be transferred to the container (13) by auger screws (25, 26) or a vacuum system comprising a fan (34) for reducing the pressure within the container (13) and causing the material to be sucked through duct (40) into the container (13). The unit may be mounted on a wheeled vehicle (12) and used to process a variety of materials from garbage to fruit.

9 Claims, 5 Drawing Sheets

MATERIALS PROCESSING UNIT

This invention relates to processing units of the kind incorporating a container, for garbage or other material and a mechanism for pulverising the material before it is transferred to the container.

An example of this kind of unit is that provided by Australia Pat. No. 534,596. In this patent the unit is mounted on the vehicle and the container is also equipped with a compactor of some description to compact the processed material once it is transferred to the container.

Existing vehicles incorporating units of the type under discussion have shown themselves to be largely satisfactory in use; however, the pulverisation process has the disadvantage of being unable to cope with a variety of materials and usually requires a large driving force to effectively pulverise the materials processed by the vehicle.

An object of the present invention is to overcome or ameliorate these disadvantages by providing a two stage processor.

According to a first aspect the invention comprises a materials processing unit comprising a container having an outlet doorway at one end, a door closable on said doorway, an inway opening in said container for admission of material to be stored in said container, a breaker unit including a casing having an inlet to admit material to be broken to said casing, and an outlet to permit discharge of broken material from said casing, a pulveriser unit mounted below said breaker unit and including a further casing having an inlet to admit material processed by said breaker unit and an outlet to permit discharge of pulverised material from said further casing, an open-ended hopper mounted by one end on the inlet to said breaker casing and having its other end positioned to accept material to be processed by said vehicle, transfer means whereby material discharged from said pulveriser outlet is transferred to said inway opening to fall therefrom into said container.

According to a second aspect, the invention provides a materials processing vehicle incorporating a wheeled frame, and comprising:

(a) a container mounted on said frame and having an outlet doorway at its trailing end, (b) a door closable on said doorway, (c) an inway opening in said container for admission of material to be stored in said container, (d) a breaker unit mounted on said frame and including a casing having an inlet to admit material to be broken to said casing, and an outlet to permit discharge of broken material from said casing, (e) a pulveriser unit mounted on said frame below said breaker unit and including a further casing having an inlet to admit material processed by said breaker unit and an outlet to permit discharge of pulverised material from said further casing, (f) an open-ended hopper mounted by one end on the inlet to said breaker casing and having its other end positioned to accept material to be processed by said vehicle, (g) transfer means whereby material discharged from said pulveriser outlet is transferred to said inway opening to fall therefrom into said container.

According to a third aspect, the invention provides a materials processing unit comprising a container having an outlet doorway at one end, a door closable on said doorway, an inway opening in said container for admission of material to be stored in said container, a pulveriser unit including a casing having an inlet to admit material to be pulverised and an outlet to permit discharge of pulverised material from the casing, an open-ended hopper mounted by one end on the inlet to said pulveriser casing and having its other end positioned to accept material to be processed by said unit, transfer means including means for producing a sub-atmospheric pressure in said container, and duct means connecting said outlet to said inway opening such that pulverised material is drawn through said duct into said container.

Preferably, at least one receiver bin is mounted on said vehicle frame and adapted to stand in a low level position for initial deposit therein of material to be processed and means to elevate said bin to a high level position are provided such that said bin is caused to discharge its contents into said open ended hopper on reaching said high level position.

Preferred embodiments of the invention will now be described, by way of example only, with reference to the accompanying drawings in which.

Figure 1:
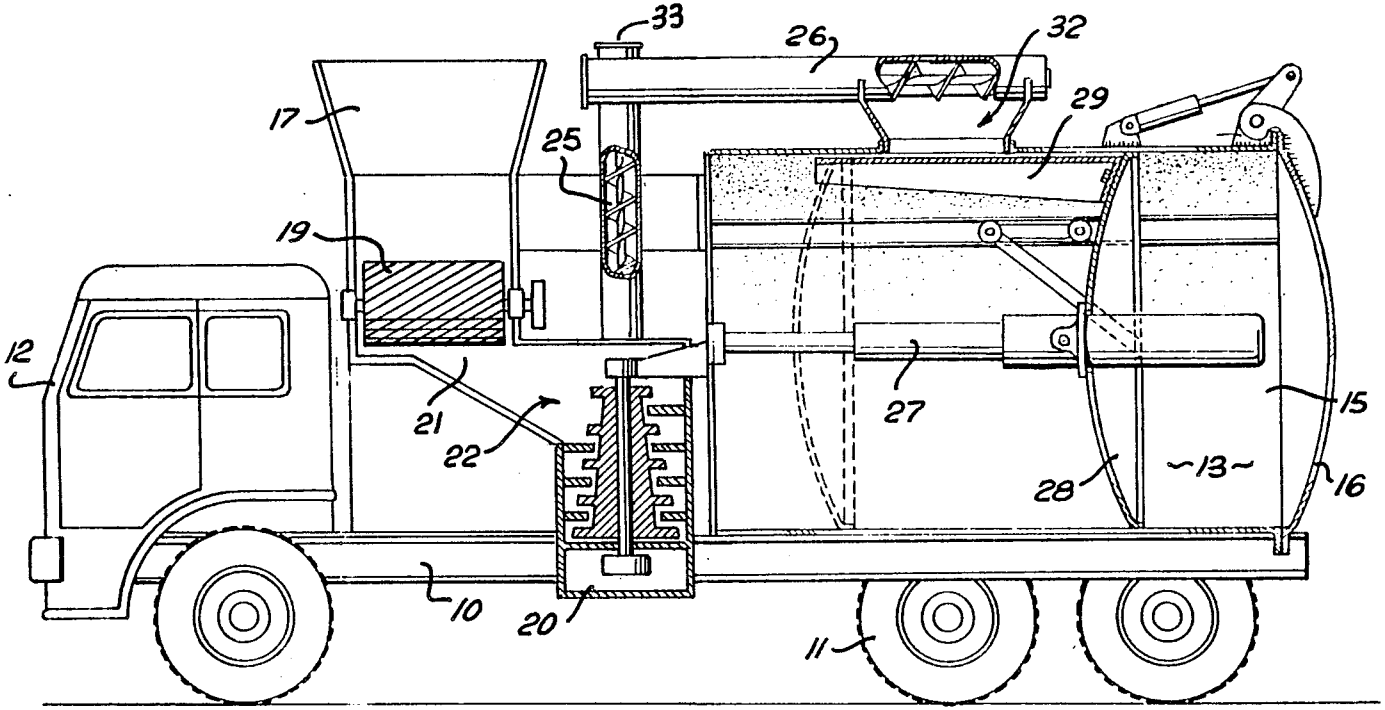
FIG. 1 is a side elevation part sectional view of the vehicle incorporating the invention.

Referring to the drawings, the materials processing vehicle chassis or frame 10 is mounted on wheels 11. This frame may be that of an automotive vehicle 12 as indicated in the figures or it may be a trailer vehicle adapted to be coupled to a prime mover in a conventional manner.

A cylindrical container 13, for pulverised material, is rigidly mounted on a frame 14. This container has an outlet doorway 15 at its trailing end and this doorway is kept closed by a door 16, except during dumping of pulverised material, when it may be raised using a hydraulic ram.

Material to be processed by the vehicle is preferably tipped into hopper 17 by means of elevatable bins 18 mounted on either side of the vehicle; however, it can be tipped in using a front end loader or other suitable means. The material then passes down to the breaker unit 19, which is a course processor for breaking up material into a suitable size before it is fed to the pulveriser unit 20 through an outlet 21 to inlet 22 of the pulveriser. The operation of the pulveriser and breaker unit will be described in more detail later.

The processor described is suitable for a variety of material ranging from building materials and general garbage to fruit products. The use of a two stage processor enables the pulveriser to be of a standard form, as the size of input product to the pulveriser will be of a standard size due to the operation of the breaker unit.

Figure 2:
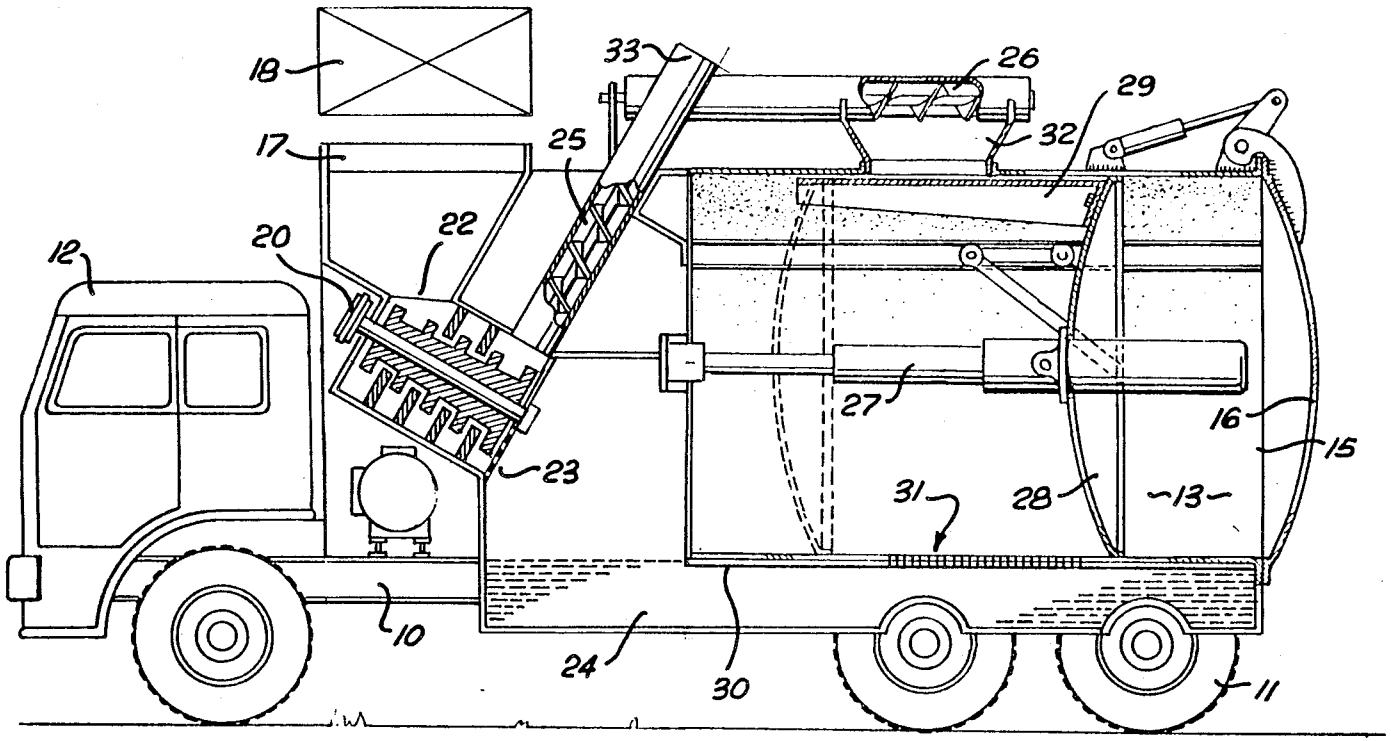
FIG. 2 is a side elevational part sectional view of the processing vehicle with modifications for juicing fruit.

An embodiment of the processor when used for fruit juicing is shown in FIG. 2. In this embodiment the pulveriser 20 is inclined at an angle and the lower end wall 23 is perforated to allow juice to drain from the fruit during the pulverisation process into a tank 24 provided below the container 13. Pulp is transferred from the pulveriser by auger screws 25 and 26 into the container 13. The container in this case is provided with a compacting ram 27 attached to a convex blade 28 which is used to compact the pulp and extract further juice. The compacting blade is provided with a guard 29 to prevent entry of material during the compacting process. The lowermost portion 30 of container 13 is provided with a plurality of drain holes 31 to enable the juice extracted to drain directly into the juice tank 24.

Alternatively, a pump (not shown) may be fitted at the base of the pulveriser unit and the juice collected therefrom pumped into an appropriately positioned holding tank.

The pulverised material may be transferred to the container 13 by a variety of means. In one embodiment of the invention shown in FIGS. 1 and 2 the pulverised material may be lifted via an auger screw (partly shown at 25) to the top of the container 13 where it is carried by a further auger screw 26 across the top of the container where it drops through an opening 32, into the container 13. An access port is provided at 33 for removal of blockages and maintenance of the screws.

Figure 4:
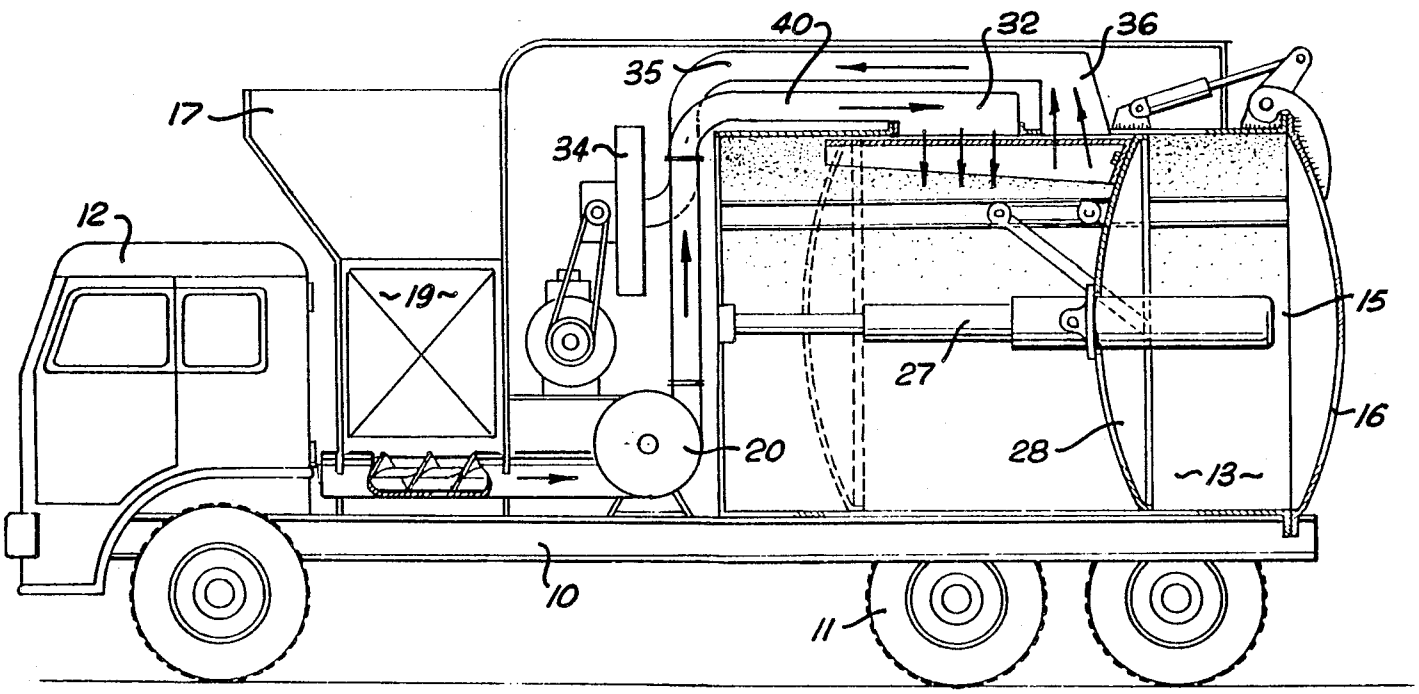
FIG. 4 is a side elevation part sectional view of the vehicle showing the air suction tranfer means and front loading embodiment of the invention.
Figure 5:
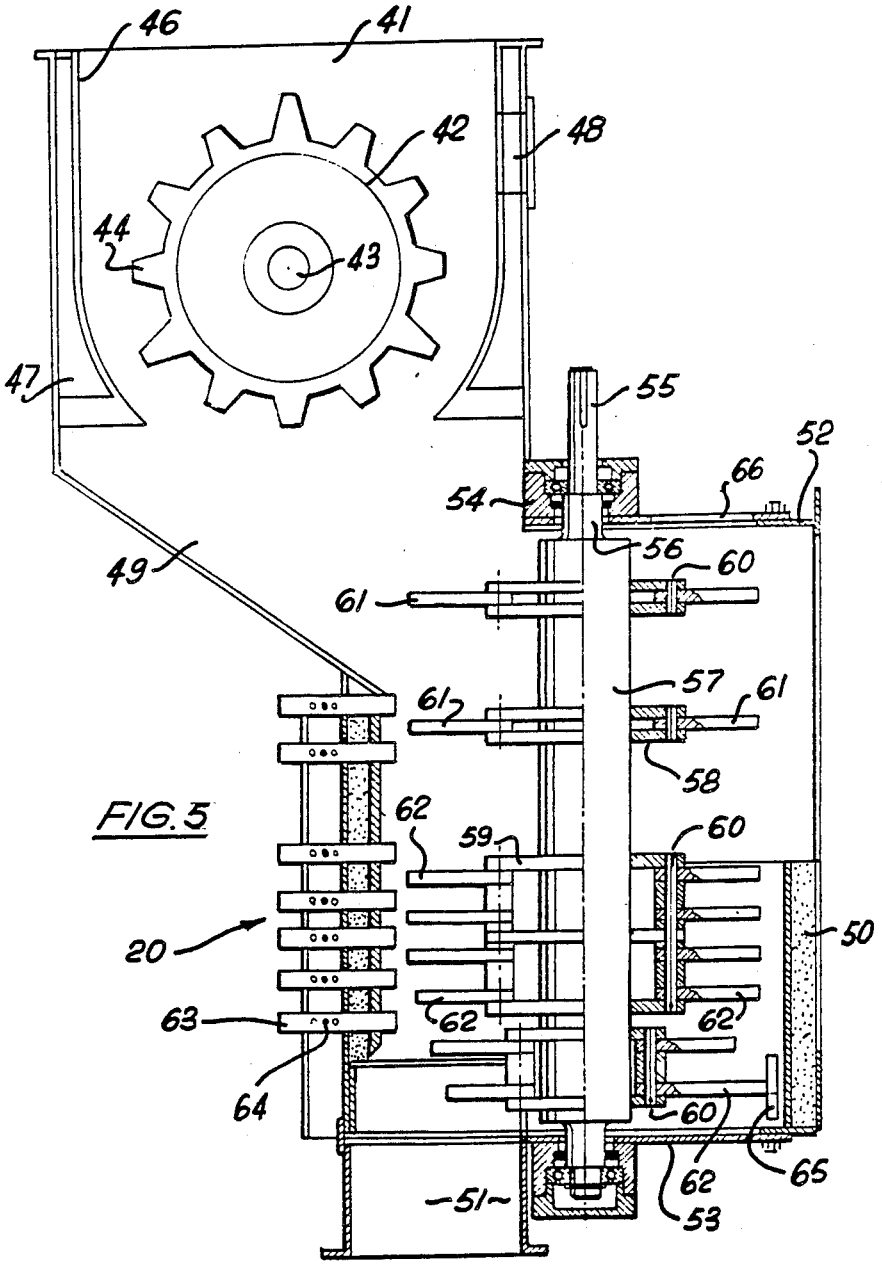
FIG. 5 is an enlarged elevational sectional view of the breaker and pulveriser units.

In the preferred form of the invention shown in FIGS. 4 and 5 the transfer means comprise a fan 34 adapted to induce a sub-atmospheric pressure in container 13 by drawing air therefrom through duct 35 via aperture 36 in the top of container 13. The reduction in pressure causes the pulverised material to be sucked through a further duct 40 into container 13.

The container 13 is constructed such that an airtight seal is maintained during movement of the compacting blade. This seal prevents any leakage of air into the container other than through duct 40. The inlet aperture 32 is sealingly closed off during operation of the compacting blade to prevent entry of material behind the blade. Alternatively, the fan 34 may be stopped when compacting is underway to prevent entry of further material during the compacting process.

Figure 3:
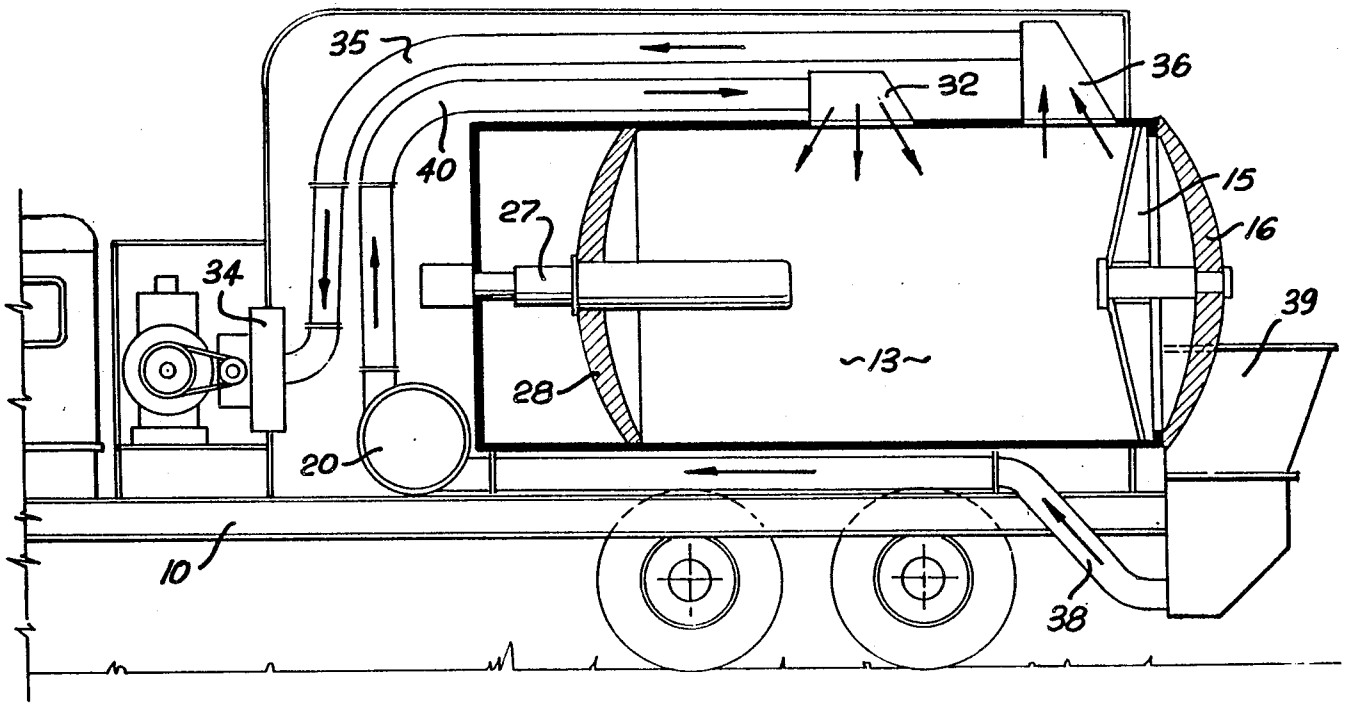
FIG. 3 is a side elevation part sectional view of the rear of vehicle showing the air suction transfer means and rear loading embodiments of the invention.

The use of this form of transfer system provides the additional advantage of causing material to be drawn into and through the processing stages of the unit. This action considerably increases the efficiency of the breaker and pulveriser units and avoids any "blow-back" problems which may arise. In FIG. 3 the material to be processed is drawn by the reduced pressure through a duct 38 from the rear loading hopper 39 into the pulveriser unit 20.

Although the embodiments shown in the drawings show either front, side or rear loading hoppers on the vehicle, it is possible to provide the vehicle with a combination of two or more of these loading variations in order to provide added flexibility to the vehicle.

According to a further embodiment the reduced pressure within the container 13 is used to draw material into the processing unit through a flexible hose or duct (not shown). This enables a processing vehicle to be operated solely by the vehicle driver. A flexible hose similar to duct 38 can be maneouvred by use of controls in the driver's cabin to suck refuse from roadside bins or other receptacles without the need to remove these bins from their support frames. When the processing unit is used to process fruit or the like the flexible hose may similarly be used to suck material from pickers' baskets.

The above described transfer means have been found preferable to carry material to the container; however, other suitable means may be used.

The processor unit will now be described in more detail with reference to FIG. 5.

The inlet chute 41 feeds material into the breaker unit which comprises a roller drum 42 rotating about a spindle 43. On the roller drum are mounted a plurality of protruding cogs 44. A number of these cogs 45 are specially hardened and protrude a greater distance from the drum than the normal cogs. Preferably these cogs are tungsten tipped. These hardened cogs act to crush the material against reinforced and hardended liners 46 which are mounted inside the chute on runners 47. The drum optimally rotates at a speed of 1500 rpm. Spindle 43 is provided with a cut-out switch (not shown) which detects overloading of the breaker unit and stops rotation of the drum. The offending material can be removed through a reject panel 48 provided on the side of the breaker unit. This cut-out switch may consist of clutch means designed to disengage drive to the drum when overload is detected.

The breaker unit shown in this embodiment uses a single roller drum; however, it will be appreciated by those skilled in the art that other forms of breaker unit are equally applicable to the invention. For example, a breaker unit using dual counter-rotating roller drums wherein the material is broken between the drums as well as against the casing is also suitable.

Once processed by the breaker unit the material drops into a chute 49 above the opening to the pulveriser unit 20. This chute acts as a small storage area whilst the pulveriser unit is operating. This area further acts to prevent blow-back of material by the pulveriser unit.

The pulveriser unit 20 has a casing 50 provided with an outlet duct 51 for departure of pulverised material. Casing end walls 52 and 53 carry bearings 54 for a vertical rotor shaft 55. This shaft is rotatable in a known manner, for example, by operation of a hydraulic motor or the like.

Shaft 56 has an elongated carrier drum 57 fixed on it, and this drum has a number of carrier plates 58 and 59 welded or otherwise concentrically fixed on it. Plates 58 and 59 carry pivot pins 60 for centrigually-outflung pulveriser blades 61 and 62. Experiment has shown that if the blades are of flat strip form as indicated in FIG. 5, they will work satisfactorily; however, for preference, these blades are slightly twisted (2° or 3° of angle is effective) so that matters struck by the blades will be given a component motion tending to impel them in the axial direction towards duct 51.

The number of blades such as 61 and 62 in each circular array thereof is not critical. They are evenly angularly spaced about the rotor, and the maximum number thereof, in each array, is that number which can be fitted to plates from the viewpoint of mechanical design. Obviously, the preferred minimum number of blades in each array is two, if for no other reason than to avoid imposing unnecessary out-of-balance loading on the rotor.

If it is desired to vary the fineness of pulverisation, a number of sationary stops 63 may be mounted on casing 50 to project radially towards the centre thereof. The use of such stops in conventional pulverising machines is well known; they operate to partially obstruct the passage of particles towards the pulveriser outlet 51 so that matter passing through, by being longer subjected to the pulverising action, is more finely fragmented. The amount by which stops such as 63 protrude towards the rotor is usually variable so as to vary the obstructive effect thereof.

This is done by providing the stops with lock nuts which permit the required adjustment. Each stop 63 is furnished with a plurality of holes 64 any one of which may be selected for insertion of a retention through-bolt or pin.

When material arrives in the pulveriser casing 50, it is first subject to a pounding by the blades 61 and all or most of the material (if not initially sufficiently fine) will be reduced to fineness such that in turning rectangularly to axially confront the array of blades 62, its fragments will be small enough to enter the working ambit of those blades, and thus, after further pulverisation, proceed to outlet 51. A sweeper blade 65 is provided on the lowermost blade 62 to sweep the finely pulverised material out of the pulveriser and through outlet 51.

If an article which is unbreakable enters the pulveriser unit but is too large to enter the aforementioned working ambit, it will be randomly kicked about by blades 61 and thus eventually be rejected by being ejected through opening 66 in the unit casing.

A detailed description of construction and operation of the elevatable receiver bins used to transfer material into the processor is given in Australian Patent specification No. 534,596.

Although the invention has been broadly described in relation to a material processing unit mounted on a vehicle of some form, the invention can equally well be applied to static locations, such as factories producing large amounts of waste products.

It will be understood by those in the art that other embodiments of the invention described are possible without departing from the scope or spirit of the invention.

I claim:

1. A materials processing unit comprising:

a container having an outlet doorway at one end, a door closable on said doorway, an inway opening in said container for admission of material to be stored in said container, a breaker unit including a casing having an inlet to admit material to be broken to said casing, and an outlet to permit discharge of broken material from said casing, said breaker unit comprising a drum mounted for rotation about a first axis and having fixedly mounted thereon a plurality of radially protruding cogs adapted to crush material entering the unit against said breaker casing during rotation of said drum, said drum being mounted transverse of said breaker unit inlet so that material entering therethrough approaches said cogs radially thereof, a pulveriser unit mounted for rotation about a second axis below said breaker unit and including a further casing having an inlet to admit material processed by said breaker unit and an outlet to permit discharge of pulverised material from said further casing, said pulveriser casing including a pair of end walls, the inlet thereof comprising an aperture adjacent one of said end walls, and the outlet thereof comprising a duct in a portion of the other of said end walls, said breaker unit having its outlet connected to the inlet of the pulveriser unit by a chute positioned below the breaker unit and to one side of the pulveriser unit, said first and second axes being angularly related so that said chute provides a collection area for output material from the breaker unit and prevents blow-back of material from the pulveriser unit into the breaker unit, an open-ended hopper mounted by one end on the inlet to said breaker casing and having its other end positioned to accept material to be processed by said vehicle, transfer means whereby material discharged from said pulveriser outlet is transferred to said inway opening to fall therefrom into said container.

2. A materials processing unit according to claim 1 including compacting means provided in said container to compact material stored therein.

3. A materials processing unit according to claim 1 wherein said transfer means comprises means for producing a sub-atmospheric pressure in said container, and duct means connecting said pulveriser unit outlet to said inway opening such that processed material is drawn through said duct means into said container.

4. A materials processing unit according to claim 3 including further duct means connected to said breaker unit inlet and adapted to suck material to be processed into said breaker unit under the action of said sub-atmospheric pressure.

5. A materials processing unit according to claim 1 wherein said transfer means comprises a screw conveyor means adapted to carry said processed material from said pulveriser outlet to said inway opening.

6. A materials processing unit according to claim 1 wherein said pulveriser casing includes a pair of end walls, an inlet aperture adjacent one of said end walls, an ejection aperture in a portion of said one of said end walls, and an outlet duct in a portion of the other of said end walls, said casing houses a rotor shaft carried in bearings mounted on said end walls, a portion of said shaft adjacent said inlet aperture has at least one array of centrifugally-outflung first pulveriser blades pivotally connected thereto so that material entering said casing by way of said inlet aperture approaches said first blades radially thereof, and the remainder of said shaft other than said portion thereof has at least one array of centrifugally outflung second pulveriser blades pivotally connected thereto so that material approaching said second blades does so in a direction axially thereof.

7. A materials processing vehicle incorporating a wheeled frame, and comprising:

(a) a container mounted on said frame and having an outlet doorway at its trailing end, (b) a door closable on said doorway, (c) an inway opening in said container for admission of material to be stored in said container, (d) a breaker unit mounted on said frame and including a casing having an inlet to admit material to be broken to said casing, and an outlet to permit discharge of broken material from said casing, said breaker unit comprising a drum mounted for rotation about a first axis and having fixedly mounted thereon a plurality of radially protruding cogs adapted to crush material entering the unit against said breaker casing during rotation of said drum, said drum being mounted transverse of said breaker unit inlet so that material entering therethrough approaches said cogs radially thereof, (e) a pulveriser unit mounted for rotation on a second axis on said frame below said breaker unit and including a further casing having an inlet to admit material processed by said breaker unit and an outlet to permit discharge of pulverised material from said further casing, said pulveriser casing including a pair of end walls, the inlet thereof comprising an aperture adjacent one of said end walls, and the outlet thereof comprising a duct in a portion of the other of said end walls, said breaker unit having its outlet connected to the inlet of the pulveriser unit by a chute positioned below the breaker unit and to one side of the pulveriser unit, said first and second axes being angularly related so that said chute provides a collection area for output material from the breaker unit and prevents blow-back of material from the pulveriser unit into the breaker unit, (f) an open-ended hopper mounted by one end on the inlet to said breaker casing and having its other end positioned to accept material to be processed by said vehicle, (g) transfer means whereby material discharged from said pulveriser outlet is transferred to said inway opening to fall therefrom into said container.

8. A materials processing vehicle according to claim 7 including at least one receiver bin mounted on said frame and adapted to stand in a low level position for initial deposit therein of material to be processed and means to elevate said bin to a higher level such that such bin is caused to discharge its contents into said open ended hopper on reaching said high level position.

9. A materials processing vehicle according to claim 7 including a liquid holding tank mounted below said container, the lowermost portions of said pulveriser casing and said container being provided with a plurality of perforations adapted to allow liquid present therein to drain into said tank.

* * * * *